United States Patent [19]

Solow

[11] 4,160,368

[45] Jul. 10, 1979

[54] AUTOMOBILE TRUNK LOCK GUARD

[76] Inventor: Joseph E. Solow, 54 Mitchell Ave., Plainview, N.Y. 11803

[21] Appl. No.: 854,795

[22] Filed: Nov. 25, 1977

[51] Int. Cl.[2] ..... E05B 63/00

[52] U.S. Cl. ..... 70/417

[58] Field of Search ..... 70/417, 452, 381, 447, 70/448, 451

[56] References Cited

U.S. PATENT DOCUMENTS

| | | | |
|---|---|---|---|
| 1,548,131 | 8/1925 | Freysinger | 70/417 |
| 3,083,563 | 4/1963 | Greenwald | 70/417 |
| 4,041,741 | 8/1977 | Cintron | 70/417 |
| 4,074,552 | 2/1978 | Smith | 70/417 |

*Primary Examiner*—Robert L. Wolfe

*Attorney, Agent, or Firm*—Brumbaugh, Graves, Donohue & Raymond

[57] ABSTRACT

An automobile lock guard for protecting a key-operated lock cylinder to prevent unauthorized entry into the automobile trunk, comprising a guard plate having an aperture formed therethrough positioned over the lock cylinder and permanently attached to the automobile surface, a circular insert plate having a diameter larger than the lock to overlie the surrounding automobile surface to prevent punching-in of the lock, and having a key slot formed therein, and means for rotatably retaining the insert plate in the guard plate aperture to prevent retraction of the insert plate and lock through the aperture of the guard plate. The lock guard may also include means to conform the guard to automobile surfaces which are other than flat.

10 Claims, 7 Drawing Figures

FIG. 1
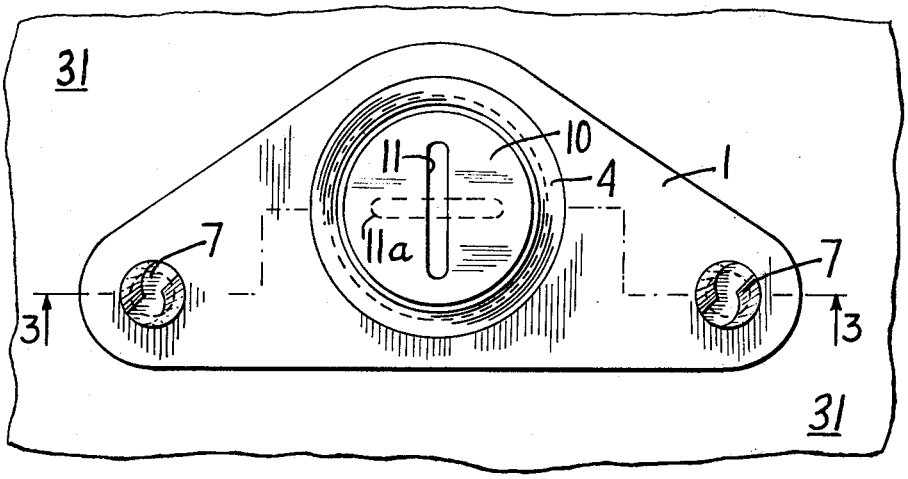
FIG. 2
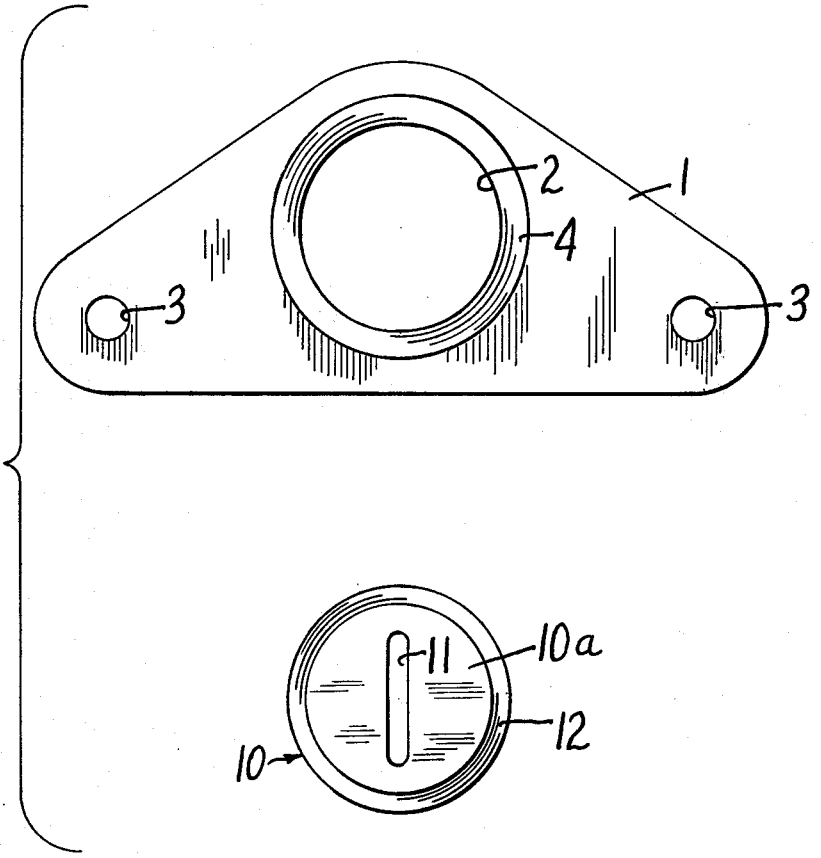
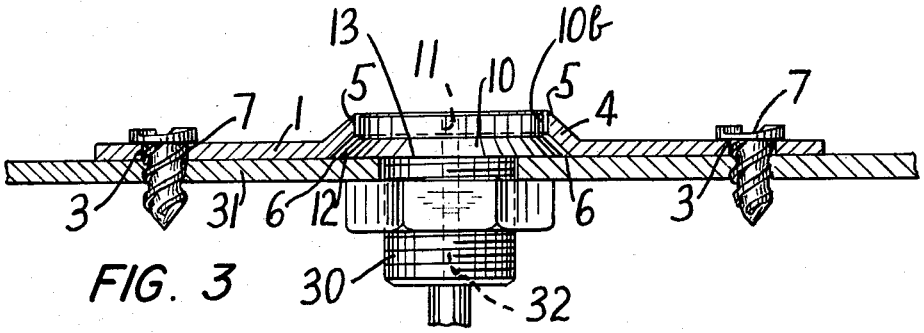
FIG. 3

AUTOMOBILE TRUNK LOCK GUARD

BACKGROUND OF THE INVENTION

Automobiles are generally provided with a number of locks to secure the automobile doors and trunk. These locks are generally disposed within apertures formed in the sheet metal of the automobile and retained therein to lie substantially flush with the exterior surface. It has been found, however, that these locks, and especially the trunk lock, are not effective against attempts at surreptitious entry by means of punching a hole in the automobile surface adjacent the locks and releasing the holding latch from within the hole.

As one means to inhibit these attempts to circumvent the lock mechanism, there is presently available a lock guard plate which consists of a flat steel plate, with an aperture formed therethrough, which is placed over the lock cylinder such that the key slot is exposed through the aperture, and permanently attached to the automobile surface by means such as one way screws. One such plate is Wolo Manufacturing Company item TC-5 trunk guard, which is attached externally to the surface of the trunk lid and reinforces the sheet metal in the vicinity of the lock cylinder.

While the use of such a device does inhibit unauthorized entry by means of punching a hole near the lock and releasing the holding latch, it has been found that entry may still be gained by removing the entire lock cylinder, either by retracting the lock through the plate aperture or by punching the lock mechanism into the car. The former may be accomplished either externally as by inserting a dent-puller into the key slot, or from behind through a hole punched into the automobile surface adjacent the lock plate. Punching-in of the lock is also easily accomplished since the lock is exposed through the aperture.

SUMMARY OF THE INVENTION

The present invention provides a device which, in addition to being effective against attempts to circumvent the lock structure by releasing the holding latch through a hole formed adjacent the lock, is also effective against an intruder attempting to remove the entire lock cylinder.

These and other advantages of the present invention are attained by providing a guard plate having a circular aperture which rotatably retains an insert plate disposed therein. The guard plate and insert plate are thereafter positioned over the lock cylinder and the guard plate is permanently attached to the automobile surface. The insert plate is formed having a diameter large enough to cover the exposed portion of the lock and at the same time overlie the surrounding surface area.

In one form of the invention, the guard plate surface adjacent the aperture is outwardly beveled to overlie the outside edge of the insert plate, which itself is correspondingly beveled to be rotatably retained by the guard plate. The insert plate is also formed with a key slot which is aligned with the key slot of the lock cylinder to permit normal operation. Removal of the lock cylinder, either externally or from behind, is prevented by means of the insert plate, which in turn is retained within the aperture by the overlying surface of the guard plate. At the same time the lock is protected from being punched-in since the outer edge of the insert plate engages the trunk surface area adjacent the lock. Normal operation of the lock cylinder is nevertheless permitted since the insert plate is rotatable with the turning of the lock key.

In another form of the invention, a trunk guard is provided which may be attached to a trunk or other automobile surface over a lock cylinder where the mounting surface is other than flat. The most common form of this contoured surface is one where the trunk lid is beveled on either side of a center ridge running vertically through the trunk lock. In order to accommodate the contour of the mounting surface, the guard plate is bendable along a cut out notch formed in the undersurface of the plate, the bend line centered through the plate aperture. Since the guard plate surface adjacent the aperture will thus bend when the plate is bent, the insert plate is not retained directly by the guard plate, but rather by a retaining collar which is fixedly retained within the lock plate aperture. The collar has a fixed portion for retaining the insert plate, and a pair of bendable ear portions engaging the guard plate for retaining the collar within the plate aperture when the plate is attached to the mounting surface. The insert plate is disposed within a circular aperture in the fixed portion of the collar and is rotatably retained therein by having a portion of the collar in the area of the aperture overlie a portion of the insert plate.

BRIEF DESCRIPTION OF THE DRAWINGS

For the purpose of illustrating the invention, reference is made to the accompanying drawings, in which:

FIG. 1 is a top elevation of an automobile lock guard embodying the present invention mounted on an automobile surface;

FIG. 2 is a top elevation of the guard plate and insert plate comprising the lock guard of FIG. 1;

FIG. 3 is a cross-sectional view of the lock guard of FIG. 1, taken through lines 3—3;

DESCRIPTION OF THE PREFERRED EMBODIMENT

Figure 4:
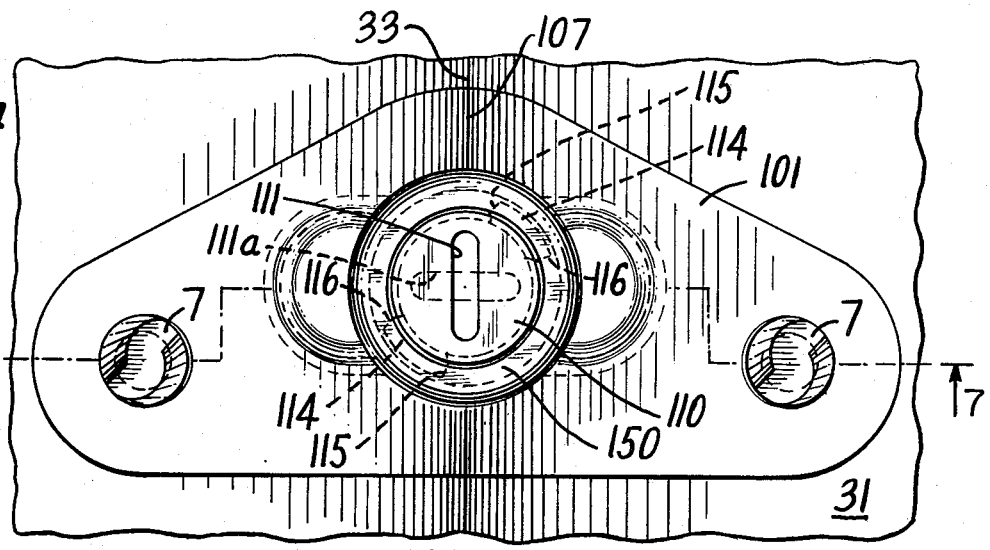
FIG. 4 is a top elevation of a bendable automobile lock guard according to the present invention mounting on a contoured automobile surface.

Referring to FIGS. 1–3, a lock guard according to the present invention is shown comprising a guard plate 1 and an insert plate 10.

The guard plate 1 is an elongated flat metal plate, and has an aperture 2 formed therethrough for positioning over a lock cylinder 30 disposed within the mounting surface 31 of an automobile body. The diameter of the aperture 2 is large enough such that when the plate 1 is positioned over the lock cylinder 30, the key slot 32 may be exposed therethrough. The guard plate 1 is also provided with a pair of mounting holes 3 which may be used to attach the guard plate 1 to the mounting surface 31.

As shown in FIG. 3, the surface 4 adjacent the aperture-forming edge 5 of the plate 1 is outwardly beveled with respect to the mounting surface 31, such that the aperture-forming edge 5 is offset from the mounting surface 31, and such that the guard plate 1 and mounting surface 31 form an annular V-shaped retaining groove 6.

The circular insert plate 10 is preferably formed of a hard surface metal, a hardened steel, a metal hardened after fabrication or having a case-hardened surface, a tempered steel, or other such hard material, in order to provide added security. The term "hard metal", when used hereafter, denotes a material in accordance with any of the aforementioned descriptions. The insert plate 10 has a flat upper surface 10*a* and a downwardly extending cylindrical portion 10*b*. The upper surface 10*a* is formed with a key slot 11 therethrough corresponding in size with the key slot 32 of the lock cylinder 30. The insert plate 10 is also formed having a diameter, and having an outside beveled edge 12 dependent from the cylindrical portion 10*b*, such that the insert plate may be rotatably retained within the annular groove 6 when the guard plate 1 is mounted to the mounting surface 31. As shown in FIG. 3, the insert plate 10 is formed such that it fits over the lock 30, which may project outwardly a small distance from the trunk surface, and the diameter of the insert plate 10 at its bottom edge 13 is large enough to overlie the surrounding trunk surface area 31 to prevent the lock from being pushed in.

In order to mount the lock guard to the mounting surface, the insert plate 10 is placed over the lock cylinder 30 such that the corresponding key slots 11 and 32 are in alignment. The guard plate 1 is then placed over the insert plate 10, such that the insert plate 10 is disposed within the aperture 2 and retaining surface 4 of the guard plate 1. Thereafter, the guard plate 1 is permanently attached to the mounting surface by means of one way sheet metal screws 7 screwed into the mounting surface 31. As thus assembled, the lock may be operated in a normal manner by means of inserting the key (not shown) through the key slots 11 and 32. Thereafter, the key may be turned since the insert plate 10 is rotatable within the guard plate 1, as illustrated by 11*a*.

At the same time, this arrangement provides extra security insofar as it prevents the lock cylinder from being removed either by retracting the lock or punching-in the lock mechanism into the car through the aperture 2. Retraction of the lock is prevented since it is retained by the insert plate 10, which is itself retained within the aperture 2 by means of the beveled edge 4 of the guard plate 2 overlying outside edge 12 of the insert plate 10. Punching-in of the lock is also prevented by the engaging insert plate bottom edge 13 and automobile surface 31.

FIGS. 4–7 illustrate another form of the invention which is a bendable lock guard comprising a guard plate 101, a retaining collar 150, and an insert plate 110.

The guard plate 101 is an elongated flat metal plate, similar to guard plate 1, having an aperture 102, and a pair of mounting holes 103 which may be used to attach the guard plate 101 to the mounting surface 31. In addition, guard plate 101 is bendable along seam 107 by means of a cut out notch 108 formed in the underside of the guard plate 101. The guard plate also has a pair of retaining channels 109 formed in the underside thereof on either side of the aperture 102 and transverse of the bend seam 107, to engage the retaining collar 150 as described further below.

The retaining collar 150 has a fixed portion 151 and a pair of bendable ears 152 on either side of the fixed portion. The fixed portion 151 of the retaining collar has a circular aperture 153 formed therein for rotatably retaining the insert plate when the trunk guard is mounted to the mounting surface 31. The insert plate 110 may be rotatably retained within the retaining collar 150 either in a manner similar to the arrangement in conjunction with FIGS. 1–3, or in the alternative, the embodiment shown in FIGS. 4–7. In the latter arrangement, the surface 154 adjacent to aperture forming edge 155 of the collar 150 is offset relative to the automobile mounting surface 31 to form, together with the mounting surface 31, an annular rectangular retaining groove 156 when the trunk guard assembly is mounted.

The ear portions 152 of the retaining collar 150 are formed for cooperation with the notch portions 109 of the guard plate 101, and since they are bendable they may be retained therein at any bend angle of the plate 101.

Figure 6:
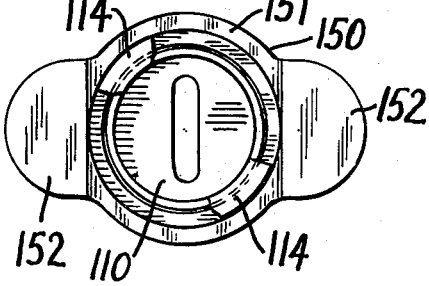
FIG. 6 is a bottom elevation of the retaining plate and insert plate assembly of the lock guard of FIG. 4.

The insert plate 110, which is preferably of hard metal as that term is used above, is formed with a key slot 111 therethrough, corresponding in size with the key slot 32 of the lock cylinder 30. The insert plate 110 is further formed having a flat upper surface 112, a downward cylindrical portion 113 extending from the upper surface 112, and a pair of flange portions 114 extending outwardly in a direction parallel with the upper surface 112 from the bottom of the cylinder portion 113. The flange portions 114 are formed such that they will be retained within the rectangular groove 156 formed by the retaining collar 150 and mounting surface 31 such that the insert plate 110 is rotatably retained therein, as best shown in FIGS. 6 and 7.

Figure 7:
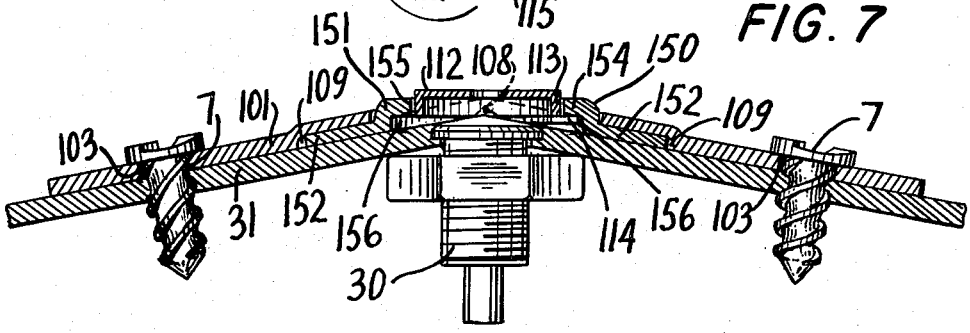
FIG. 7 is a cross-sectional view of the lock guard of FIG. 4 taken through lines 7—7.

As shown in FIG. 7, the insert plate 110 is formed large enough such that the lock 30 may project up into the cylindrical portion 113, and such that the bottom surface of the insert plate 110 overlies the surrounding automobile surface area 31 to prevent the punching-in of the lock 30.

In order to mount the lock guard to the mounting surface, the guard plate 101 is first bent along its seam 107 to correspond to the contour of the mounting surface 31 on either side of the mounting surface ridge 33. The bendable ears 152 of the retaining collar 150 are thereafter correspondingly bent such that the retaining collar 150 may be snugly retained within the aperture 102 of the guard plate 101. With the trunk guard assembly thus ready for mounting, the insert plate 110 is placed over the lock cylinder 30 and the key slots 111 and 32 aligned. The retaining collar 150 is then placed over the insert plate 110 such that the insert plate 110 is disposed within the aperture 153 and the flange portions 114 disposed within the retaining groove 156 formed by the retaining collar 150 and mounting surface 31. Finally, the guard plate 101 is placed over the retaining collar 150 such that the ear portions 152 of the retaining collar 150 are disposed within the retaining channels 109 of the guard plate, and the guard plate is permanently attached to the mounting surface by way of one way sheet metal screws 7.

Figure 5:
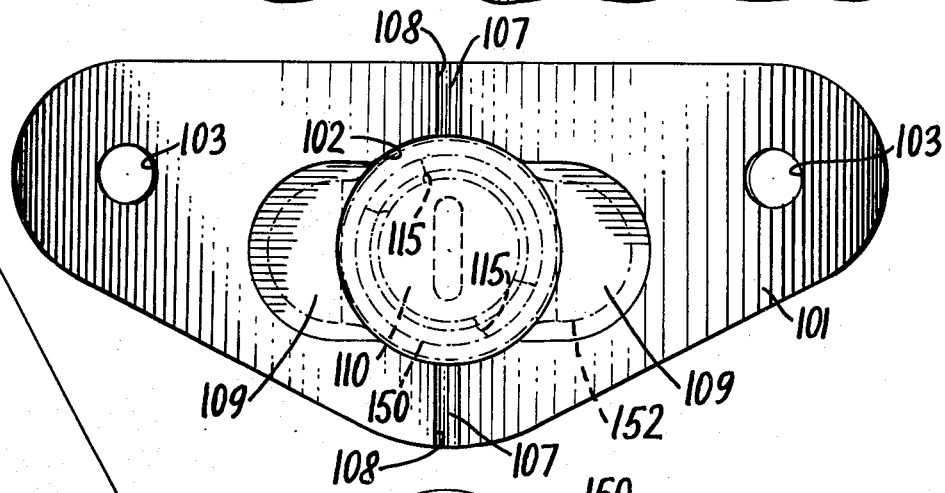
FIG. 5 is a bottom elevation of the guard plate, retaining collar, and insert plate comprising the lock guard of FIG. 4.
Figure 5:
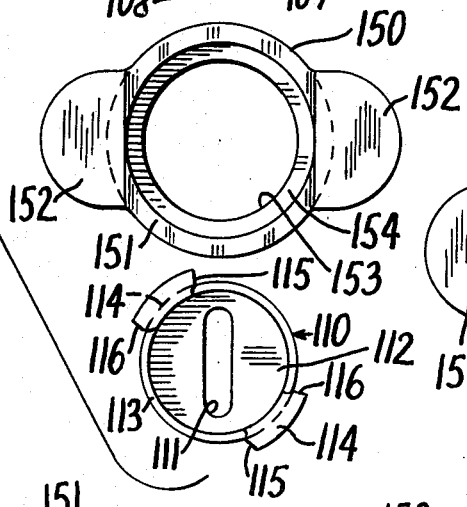

As thus assembled, the key may be operated in a normal manner by means of inserting the key through the key slots 111 and 32. Thereafter, the key may be turned since the insert plate 110 is rotatable within the retaining collar 150, as illustrated by 111*a*. It is possible, if desired, to limit the degree of rotation through which the insert plate 110 may be turned, when used with a contoured trunk arrangement. By bending flange portions 114 of the insert plate 110 slightly in a downward direction, upon rotation of the insert plate 110 the leading and trailing edges, 116 and 115 respectively, of the flange portions 114 will engage the mounting surface ridge 33. In the solid position of the key slot 111 illustrated in FIG. 4, the ridge 33 is colinear with the key slot 111. As shown in FIGS. 4 and 5, in this position the trailing edges 115 of the flange portions 114 are substantially juxtaposed to the ridge 33, and thus the insert plate may be rotated only in a clockwise direction (FIG. 4). Upon rotation of the insert plate, the leading edges 116 of the flange portions 114 will encounter the ridge 33 after approximately a 90° rotation, as shown by 111*a*. The amount of rotation permitted may be varied by changing the size of the flange portions 114.

As does the lock guard of FIGS. 1–3, this arrangement also protects the lock cylinder from unauthorized removal either by retracting the lock or punching the lock mechanism into the car through the aperture 102. Retraction of the lock is prevented since it is retained by the insert plate 110, which in turn is retained by the retaining collar 150 and guard plate 101. Punching-in of the lock is also prevented by the engaging bottom edge of the cylinder portion 113 of the insert plate 110 and the trunk surface 31.

As an alternative to having a pair of opposing flange portions 114, the insert plate 110 may be formed with a continuous flange around the base which would be disposed within the retaining groove 156 in the same manner as flanges 114. Thus this alternative insert plate would still be rotatable within the retaining collar 150, but offers the advantage of being more strongly retained due to its larger flange portion.

The embodiment of the invention described herein is merely illustrative and the invention may be embodied in other forms while still employing the inventive principles contained herein. Thus, the means for rotatably retaining the insert plate could be further modified while still providing the primary features of this invention, namely, a lock guard which protects the lock from removal or tampering, while at the same time permitting normal operation with the key. All such modifications and variations are meant to be within the scope of the invention as contained in the following claims.

I claim:

1. An automobile trunk lock guard for securing a key-operated lock cylinder disposed within a mounting aperture formed in the exterior trunk lid surface of an automobile, comprising:

a guard plate having an aperture formed therethrough, wherein the surface of the guard plate adjacent the guard plate aperture is outwardly beveled with respect to the plate surface to form, with the trunk surface, an annular retaining groove when the guard plate is mounted to the trunk surface;

a circular insert plate having an outside edge correspondingly beveled to said outwardly beveled surface of said guard plate and adapted to be rotatably retained by the guard plate when said plate is mounted to the trunk surface; and means for attaching the guard plate to the trunk surface of the automobile.

2. An automobile trunk lock guard according to claim 1, wherein the insert plate is formed of a hard metal.

3. An automobile trunk lock guard according to claim 1, further comprising means for conforming the lock guard to a contoured trunk surface.

4. An automobile trunk lock guard according to claim 3, further comprising a retaining collar having a fixed portion with an aperture formed therethrough for rotatably retaining the insert plate, and bendable portions which engage the plate for retaining the collar within the plate aperture when the plate is attached to the trunk surface.

5. An automobile trunk lock guard according to claim 3, wherein said guard plate has a substantially flat underside, and wherein said means for conforming comprises a notch in said underside along a line through said guard plate aperture, said guard plate adapted to be bent along said line, and a retaining collar having a fixed portion with an aperture adapted to engage said beveled outside edge of said insert plate to rotatably retain said insert plate, said retaining collar further comprising a pair of oppositely disposed ears extending from said fixed portion, and said guard plate has a pair of cut-outs transversely arranged to said line for receiving said cut-outs.

6. An automobile trunk lock guard for securing a key-operated lock cylinder disposed with a mounting aperture formed in the exterior trunk lid surface of an automobile, comprising:

a guard plate having a substantially flat undersurface for mounting on said trunk surface, said plate having an aperture formed therethrough and a notch in said underside along a line through said aperture, wherein said plate is adapted to be bent along said notch;

a retaining collar having a fixed portion with an aperture formed therethrough and bendable portions extending from said fixed portion adapted to engage said underside for retaining said collar in the plate aperture when said guard plate is mounted to said trunk surface;

a circular insert plate having a key slot formed therethrough, said insert plate including means adapted to engage said retaining collar to be rotatably retained within the retaining collar aperture when said guard plate is attached to said trunk surface; and means for attaching said guard plate to said trunk surface.

7. An automobile trunk lock guard according to claim 6, wherein said line bisects said aperture, and wherein said bendable portions comprise a pair of ears oppositely disposed on said retaining collar.

8. An automobile trunk lock guard according to claim 7, wherein said plate includes cut-outs in said underside transverse of said line for receiving said ears.

9. An automobile trunk lock guard according to claim 8, wherein the surface of said retaining collar adjacent its aperture-forming edge is offset relative to said trunk surface when the trunk guard is mounted to said trunk surface, and wherein said insert plate has flanged portions extending outwardly therefrom and adapted such that said aperture-forming edge overlies the flanged portions of the insert plate to rotatably retain the insert plate when said lock guard is mounted to the trunk surface.

10. An automobile trunk lock guard according to claim 8, wherein the surface of said retaining collar adjacent its aperture-forming edge is outwardly beveled with respect to the surface of said retaining collar to form, with the trunk surface, an annular retaining groove when said lock guard is mounted to the trunk surface, and wherein the outside edge of said insert plate is correspondingly beveled and adapted to be rotatably retained by said retaining collar when said lock guard is mounted to said trunk surface.

* * * * *